United States Patent [19]

Rand

[11] 4,202,279

[45] May 13, 1980

[54] STICKY FOAM

[75] Inventor: Peter B. Rand, Albuquerque, N. Mex.

[73] Assignee: The Unites States of America as represented by the United States Department of Energy, Washington, D.C.

[21] Appl. No.: 832,488

[22] Filed: Sep. 12, 1977

[51] Int. Cl.[2] ..... E05G 5/02; G08B 15/00; G08B 15/02

[52] U.S. Cl. ..... 109/34; 70/1.5; 222/180; 252/305; 252/359 A; 43/59; 521/913

[58] Field of Search ..... 252/359 A, 305; 109/20, 109/29, 34, 42; 222/180, 541; 521/78, 79, 80, 81, 917, 913, 141, 142; 70/1.5; 43/59, 114

[56] References Cited

U.S. PATENT DOCUMENTS

| | | | |
|---|---|---|---|
| 1,355,063 | 10/1920 | Roeschel | 109/34 |
| 2,804,029 | 8/1957 | Fitzgerald | 109/34 |
| 2,915,251 | 12/1959 | North, Jr. | 252/359 A X |
| 3,096,001 | 7/1963 | Boe et al. | 521/78 X |
| 3,240,396 | 3/1966 | Friedenberg | 252/359 A |
| 3,343,718 | 9/1967 | Siegel et al. | 252/359 A |
| 3,572,330 | 3/1971 | Gander | 521/78 X |
| 3,679,599 | 7/1972 | Goldsmith | 252/359 A X |
| 3,791,983 | 2/1974 | Maierson | 252/305 |
| 3,929,755 | 12/1975 | Severson et al. | 260/27 R X |
| 3,951,894 | 4/1976 | Whelan, Jr. | 260/27 BB |
| 3,956,997 | 5/1976 | Hall | 109/20 |
| 4,036,673 | 7/1977 | Murphy et al. | 521/78 X |
| 4,147,831 | 4/1979 | Balinth | 260/27 R X |

*Primary Examiner*—Joseph Scovronek
*Assistant Examiner*—Roger F. Phillips
*Attorney, Agent, or Firm*—R. V. Lupo; Dudley W. King; Robert Southworth, III

[57] ABSTRACT

Access to a space is impeded by the generation of a sticky foam from a tacky polymeric resin and a low boiling solvent.

8 Claims, 3 Drawing Figures

STICKY FOAM

BACKGROUND OF THE INVENTION

The invention relates to a means for delaying, denying or impeding access to materials or spaces employing a sticky foam. This sticky foam may be generated from a mixture of a tacky thermoplastic resin and a low boiling solvent. While thermoplastic materials have been employed in foamed compositions before, these compositions have been used for their structural or insulating properties and, not being sticky, are not suitable for access denial.

SUMMARY OF THE INVENTION

In view of the above, it is an object of this invention to provide a composition for producing a thermoplastic foam which is sticky.

It is a further object of this invention to provide a sticky thermoplastic foam useful in denying, delaying, or impeding access to protected materials or areas.

The invention comprises dissolving a tacky thermoplastic resin in a low boiling solvent under pressure. Upon release to atmospheric pressure, the solvent vaporizes creating bubbles within the resin and thereby generating a sticky foam. The properties of the foam may be modified by adding such other materials as nucleating agents, surfactants, or fire retardants.

DESCRIPTION OF THE PREFERRED EMBODIMENT

A composition of matter for the production of a sticky foam may be prepared by dissolving a tacky thermoplastic resin in a low boiling solvent under pressure. When the pressure is released, the low boiling solvent vaporizes and a sticky foam is generated.

It has been found that almost any viscous, tacky resin is suitable for use in the composition. These resins are of the type that are normally used as tackifiers in pressure sensitive adhesive formulations. The following resins have been found to be suitable: a thermoplastic resin comprising a blend of styrene/butadiene copolymer and polyindene, a styrene-isoprene thermoplastic elastomer, a polyterpene, an elastomeric resin, and a polyisobutylene resin.

The low boiling solvent serves both to dissolve the resin and to provide a gas for blowing the foam. Suitable solvents will typically have boiling points below −20° C. and a vapor pressure of 4 $Kg/cm^2$ at 20° C. In addition, the stability of the foam is enhanced by using a solvent producing a gas which diffuses slowly through the membrane which forms the wall of the bubbles within the foam. The following low boiling solvents have been found to be particularly suitable for practicing this invention: dichlorodifluoromethane, methyl chloride, and dimethyl ether.

The addition of a nucleating agent promotes the formation of fine celled foam. It is thought that this is because these agents provide sites for the heterogeneous nucleation of the blowing agent. Fine particle polyethylene, carbon black, fine particle silica, and dissolved carbon dioxide have been found to be particularly suitable for practicing this invention. In addition, these nucleating agents have been found to reinforce the foam by increasing the viscosity of the resin.

It has been found that the addition of other substances may be appropriate to modify the characteristics of the foam. The addition of fire retardant chemicals, such as chlorinated paraffin, imparts self-extinguishing properties to the foam. The addition of an organo-silicone surfactant increases the foam stability by an order of magnitude.

The foams are prepared by preblending the resin and additives and placing in a suitable pressure container. The solvent is added to the container and it is sealed. If carbon dioxide is used, it may be added to the container at this point. The preblend is dissolved by slowly rotating the pressure container for 12 to 24 hours. Most preblends will dissolve without rotating the container, but longer times are required. The foam is generated upon opening or rupturing of the container and releasing the contents to atmospheric pressure.

Figure 1:
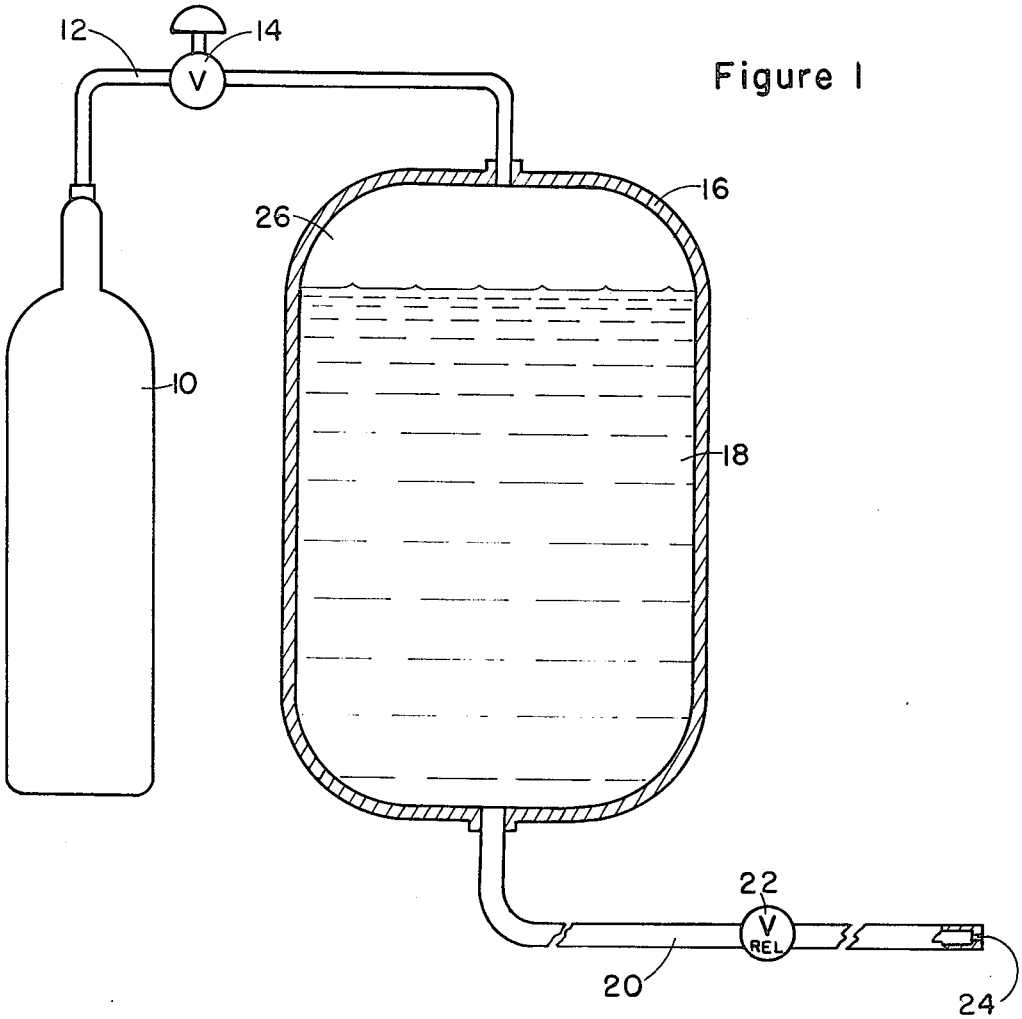
FIG. 1 is a partial cross-sectional view showing an apparatus suitable for generating the sticky foam.

Shown in FIG. 1 in partial cross section is an apparatus or system which is suitable for generating the sticky foam. The sticky foam generating solution 18 is contained within a vessel or reservoir portion 16. Above the solution may be ullage 26 for solvent vapors or $CO_2$ gas.

Pressurizing gas may be contained in pressurized gas supply 10, and upon actuation of gas valve 14, gas flows through gas conduit 12 into vessel 16. When the pressure within the vessel reaches a predetermined value, burst valve 22 ruptures allowing the contents of vessel 16 to flow through solution conduit 20 to delivery orifice 24, and thence into the surrounding space, where the foam is generated, or when reservoir portion 16 or conduit portion 20 is ruptured the composition or solution 18 exudes through the rupture and foam is generated.

Figure 2:
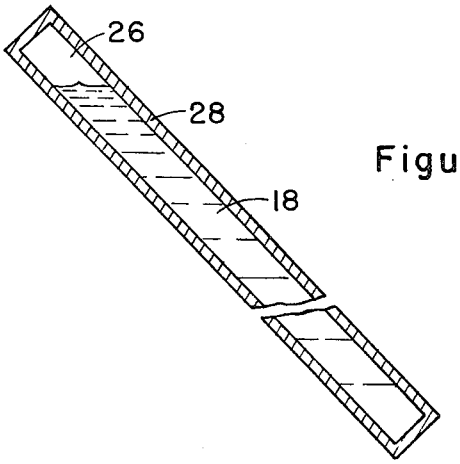
FIG. 2 is a cross-sectional view showing an apparatus suitable for dispensing the sticky foam.

Shown in FIG. 2 in a cross section is another form of apparatus or system for generating sticky foam. The foam generating composition 18 is contained within a rupturable conduit or vessel 18, such as an aluminum tube closed at its ends. Once again, reservoir or ullage portion 26 contains pressurizing gas such as $CO_2$ and solvent vapors. The rupturable reservoir or conduit portions may be of any appropriate length or configuration and may be disposed within the walls of an enclosed space.

Any unauthorized attempt to gain entry to the enclosed space with the use of hand tools or small power tools may rupture the vessel 28 and thereby allow the exuding of an engulfing sticky foam. This foam sticks to the tools or the individual attempting to use them and thus render both ineffective.

TABLE I

| Temp °C. | Shear Visc@ 25 $Sec^{-1}$ Pa.s | First Normal Stress Diff Pa | Storage Shear Modulus @ 0.2Hz Pa |
|---|---|---|---|
| 10 | $4.51 \times 10^4$ | $3.6 \times 10^5$ | |
| 20 | $1.18 \times 10^4$ | $1.12 \times 10^5$ | $6.65 \times 10^3$ |
| 40 | $2.28 \times 10^3$ | $1.7 \times 10^4$ | $1.2 \times 10^3$ |
| 60 | $2.80 \times 10^2$ | $8 \times 10^2$ | $4.63 \times 10^2$ |
| 100 | 7.2 | | |

Figure 3:
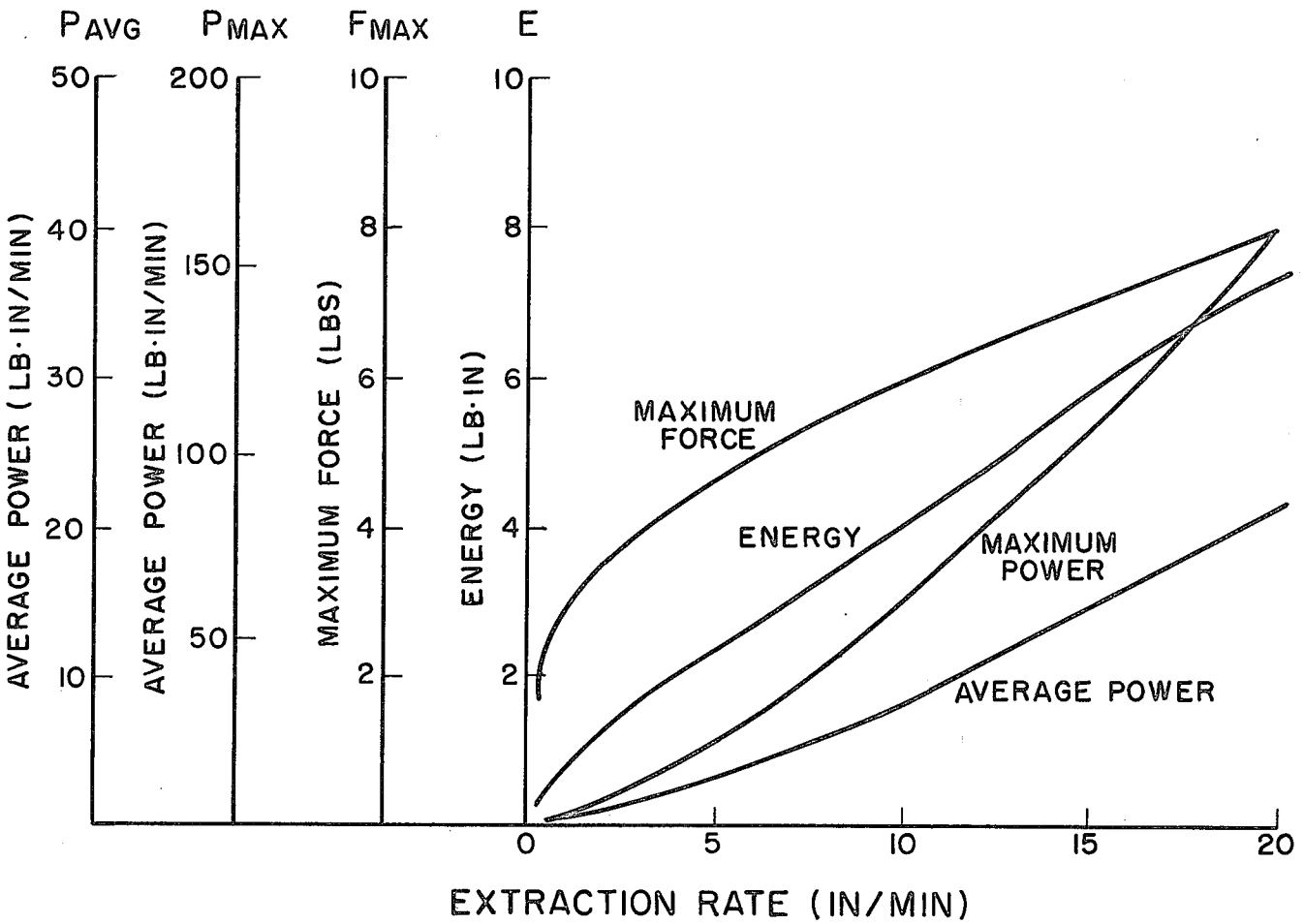
FIG. 3 is a graph showing the force, energy, and power required to extract a rod from the sticky foam.

Same typical rheological properties of a sticky foam resin are shown in Table I. For access denial application, an important parameter is the tenacity by which the foam grips an intruder or his tools and the effort required to free himself of this grip. Shown in FIG. 3 are the force, energy, and power required to extract a 1 inch diameter PTFE rod which has been inserted ¼ inch into the sticky foam at 70° F.

A design problem related to the rheological properties of the foam is influenced by the fact that the foamed polymer has a higher viscosity than the unfoamed polymer while having a lower density. This means that if the composition or solution foams in the conduit portion 20 prior to discharge, the desired flow rate may not be achieved. To ensure the desired flow rate a delivery orifice 24 may be provided on the discharge end of the solution conduit. This will tend to keep the solution pressurized and unfoamed until it is discharged from the orifice.

It has also been found that, as viscosity is dependent upon temperature, the optimum delaying characteristics of the foam may be exhibited between 32° F. and 125° F. Through appropriate adjustments in the foam formulation, such as the utilization of elastomers with lower glass points, this range may be altered. Through appropriate heating, cooling, or insulating means the sticky foam may be delivered at such a temperature as to optimize its properties.

EXAMPLE I

Preblend A is prepared by first blending 30 parts of a first chlorinated paraffin with 1.4 parts carbon black in a ball mill.

Preblend B is prepared by heating Preblend A to 240±10° F. and adding 1.4 parts of a silicone surfactant and 10 parts chlorinated paraffin and mixing.

Preblend C is prepared by carefully heating 100 parts of a thermoplastic resin comprising a blend of styrene/-butadiene copolymer and polyindene and adding Preblend B and mixing.

Preblend C is placed in a pressure vessel and 43 parts of dichlorodifluoromethane are added. The vessel is pressurized with $CO_2$ gas to 160 psig before final mixing. This mixing is achieved by rotating the pressurized vessel at a rate of from one to ten rpm for a period of twenty-four hours.

When this mixture is dispensed through a ¼ inch copper tubing it will form a sticky foam having a density of 1.8±0.3 lbs/ft$^3$ and will have stability such that the foam will not show any volume decrease on standing for one hour at 70°±10° F.

EXAMPLE II

A sticky foam is prepared by heating 12 parts of a styrene-isoprene thermoplastic elastomer to 260°±10° F. and slowly adding 88 parts of polyterpene in an intensive mixer. The hot mixture is poured into a pressure vessel, and the vessel is agitated as the mixture cools.

a solvent blend of 40 parts of dichlorodifluoromethane and 10 parts of methyl chloride is added to the pressure and the vessel is pressurized to 160 psig with carbon dioxide. The contents are agitated by rolling in a manner similar to that described in Example I.

The sticky foam is generated by discharging the contents of the pressure vessel into the ambient surroundings.

EXAMPLE III

A sticky foam with a density of 1.8 lb/ft$^3$ is prepared in a manner similar to that of Example I using the following ingredients:

| | | |
|---|---|---|
| Thermoplastic resin | 100 | parts |
| First chlorinated paraffin | 10 | |
| Second chlorinated paraffin | 30 | |
| Silicone surfactant | 1.4 | |
| Dichlorodifluoromethane | 64 | |

EXAMPLE IV

A sticky foam with a density of 20 lb/ft$^3$ is prepared in a manner similar to that of Example I using the following ingredients:

| | | |
|---|---|---|
| Elastomeric resin | 100 | parts |
| Powdered polyethylene | 5 | |
| Dimethyl ether | 50 | |

EXAMPLE V

A sticky foam with a density of 5 lbs/ft$^3$ is prepared in a manner similar to that of Example I using the following ingredients:

| | | |
|---|---|---|
| Polyisobutylene resin | 90 | parts |
| Elastomeric resin | 10 | |
| Fine particle silica | 5 | |
| Dichlorodifluoromethane | 50 | |

EXAMPLE VI

A sticky foam with a density of 2.9 lb/ft$^3$ is prepared in a manner similar to that of Example I using the following ingredients:

| | | |
|---|---|---|
| Polyisobutylene resin | 100 | parts |
| Fine particle silica | 5 | |
| Dichlorodifluoromethane | 40 | |

EXAMPLE VII

A sticky foam with a density of 1.5 lb/ft$^3$ is prepared in a manner similar to that of Example I using the following ingredients:

| | |
|---|---|
| Thermoplastic resin | 100 |
| First chlorinated paraffin | 30 |
| Second chlorinated paraffin | 10 |
| Silicone surfactant | 1.35 |
| Carbon black | 1.35 |
| Dichlorodifluoromethane | 48 |

The following products are illustrative of those which may be used in the above examples, but this is not to exclude the use of other products or to imply the endorsement of any particular product.

The first and second chlorinated paraffins may be Chlorowax 40 and Chlorowax 70 made by the Diamond Shamrock Chemical Company or Unichlor 40-150 or Unichlor 70 L-190 made by Neville Chemical Company. The thermoplastic resin may be Stickvel P which is a styrene/butadiene copolymer and polyindene product of the Velsicol Chemical Company. The thermoplastic elastomer may be Kraton 1107 which is a styrene-isoprene elastomer made by the Shell Chemical Company. The elastomeric resin may be Vistanex LM-MS made by the Exxon Chemical Company. The polyisobutylene resin may be Polyvis 200 SH as marketed by the Cosden Chemical Company. The polyterpene may be Goodyear Rubber Company's Wingtack 10. The silicone surfactant may be L-550 made by the Union Carbide Corporation or PFA-1660 made by the General Electric Company. The carbon black may be the Cabot Corporation's Vulcan XC-72R. The fine particle silica may be Silcron G-100 as sold by Glidden Pigments. The powdered polyethylene may be the Microthene FN-510 product of the ICI Chemicals.

The various features and advantages of the invention are thought to be clear from the foregoing description. However, various other features and advantages not specifically enumerated will undoubtedly occur to those versed in the art, as likewise will many variations and modifications of the preferred embodiment illustrated, all of which may be achieved without departing from the spirit and scope of the invention as defined by the following claims.

I claim:

1. System for impeding access to a space by attack with individual hand tools to gain entry to the space comprising in combination a reservoir portion containing a gas under pressure, a conduit portion communicating with said reservoir portion disposed to impede access to the space, sticky foam generating composition of high tenacity contained within the conduit portion, said reservoir and communicating conduit portion together forming a closed system with impervious walls normally maintaining said composition in substantially liquid condition under pressure, the tenacious sticky foam generating composition contained within the conduit comprising a tacky polymeric resin intermixed with a low boiling solvent and under pressure of said gas, rupture of a wall portion of said system effecting rapid exuding of composition through said rupture and formation of a sticky hand-tool-engulfing foam of high tenacity.

2. The means for impeding access of claim 1 wherein the sticky foam generating composition further comprises an organo-silicone surfactant.

3. The means for impeding access of claim 1 wherein the sticky foam generating composition further comprises a fire retardant.

4. The means for impeding access of claim 3 wherein the fire retardant is a chlorinated paraffin.

5. The means for impeding access of claim 1 wherein the tacky polymeric resin is polyisobutylene, a mixture comprising styrene/butadiene copolymer and polyindene, or a mixture comprising styrene/isoprene copolymer and polyterpene.

6. The means for impeding access of claim 1 wherein the low boiling solvent is dimethyl ether, dichlorodifluoromethane, or methyl chloride.

7. The means for impeding access of claim 1 wherein the sticky foam generating composition further comprises a nucleating agent.

8. The means for impeding access of claim 7 wherein the nucleating agent is powdered polyethylene, fine particle silica, carbon black, or carbon dioxide.

* * * * *